United States Patent [19]

Kuwata

[11] Patent Number: 4,515,205

[45] Date of Patent: May 7, 1985

[54] METHOD FOR FLUIDIZED PARTICLE TRAY HEAT EXCHANGE

[75] Inventor: Masayoshi Kuwata, Ballston Lake, N.Y.

[73] Assignee: General Electric Company, Schenectady, N.Y.

[21] Appl. No.: 560,651

[22] Filed: Dec. 12, 1983

Related U.S. Application Data

[62] Division of Ser. No. 314,817, Oct. 26, 1981, Pat. No. 4,442,888.

[51] Int. Cl.[3] ..... F28C 3/16

[52] U.S. Cl. ..... 165/1; 165/104.16; 165/DIG. 12; 122/4 D

[58] Field of Search ..... 165/104.16, 104.14, 165/1; 122/4 D; 422/146, 139, 143, 145

[56] References Cited

U.S. PATENT DOCUMENTS

| | | | |
|---|---|---|---|
| 2,884,373 | 4/1959 | Bailey | 165/104.16 |
| 3,814,176 | 6/1974 | Seth | 165/104.16 |
| 3,912,002 | 10/1975 | Elliott | 165/104.16 |

FOREIGN PATENT DOCUMENTS

| | | | |
|---|---|---|---|
| 1431763 | 4/1976 | United Kingdom | 122/4 D |
| 2065493 | 7/1981 | United Kingdom | 165/104.16 |
| 288889 | 12/1970 | U.S.S.R. | 165/104.16 |
| 565194 | 7/1977 | U.S.S.R. | 165/104.16 |

*Primary Examiner*—Albert W. Davis, Jr.
*Attorney, Agent, or Firm*—George B. Fox; James C. Davis, Jr.; Bernard J. Lacomis

[57] ABSTRACT

A heat exchanger system exhibits an improved coefficient of heat transfer over a conventional convection heat exchanger while maintaining the beneficial high temperature driving force of conventional convection heat exchanger. A plurality of heat extraction means are provided in heat flow communication with a plurality of shallow beds of particulate matter, which beds are fluidized by a heat-laden gas stream.

A method for extracting heat from a heat-laden gas stream is also disclosed.

6 Claims, 3 Drawing Figures

METHOD FOR FLUIDIZED PARTICLE TRAY HEAT EXCHANGE

This application is a division of application Ser. No. 314,817, filed 10/26/81, now U.S. Pat. No. 4,442,888 granted Apr. 4, 1984.

BACKGROUND OF THE INVENTION

This invention relates to a convection heat exchanger system. More particularly, it relates to a means for increasing the effectiveness of a convection heat exchanger system with respect to a conventional convection heat exchanger system.

By definition, the effectiveness of a heat exchanger is the ratio of the heat extracted to the maximum possible heat which could be extracted from a source of heat for a given sink temperature. Thus, the effectiveness of a heat exchanger system is a function of the heat transfer coefficient and the temperature driving force.

In a typical conventional convection heat exchanger system, a plurality of heat transfer surfaces in heat flow communication with a heat transfer medium are disposed in stages which are sequentially contacted by a heat-laden gas stream. The temperature of the gas contacting a stage, and thereby the temperature driving force, decreases at each successive stage in the gas flow path of the system. Although high initial temperature driving forces are attainable with this system, the heat transfer coefficient and therefore the quantity of heat which can be transferred per unit of heat transfer area is relatively low.

The temperature driving force experienced by a stage of a heat exchanger system is the difference in temperature between the heat-laden gas at the heat transfer surface of the stage and the temperature of the heat transfer medium at the stage. In general, the larger the temperature driving force, the more effective is the heat exchange at the heat transfer surface.

By way of illustration, heat recovered from a heat-laden gas stream input to a heat exchanger system may be used to generate steam when the heat transfer medium is water. The heat transfer medium of each stage of the heat exchanger may be fed to a common point, as a header. The temperature driving force would be the difference between the gas temperature at the stage and the temperature of the heat transfer medium at the stage.

By positioning the heat transfer surfaces of a conventional convection heat exchanger in heat flow communication with a bed of particulate matter which is supported by a gas distributor and using a heat-laden gas stream for fluidizing the bed, the heat transfer coefficient of the heat exchanger can be increased. However, due to the temperature uniformity associated with a fluidized bed, each of the stages of the heat exchanger system would be subjected to substantially the same temperature. Thus, the effectiveness of having a large temperature driving force would be lost. The uniform temperature of the fluidized bed will decrease as more heat transfer surface area is added to the system.

Although a larger temperature gradient between the input and output temperatures and thereby a larger temperature driving force can be obtained by the use of a multistage fluidized bed, a relatively high pressure loss associated with a conventional fluidized bed severely limits the number of stages which can be used.

SUMMARY OF THE INVENTION

One object of the present invention is to increase the effectiveness of a heat exchanger system with respect to a conventional convection heat exchanger system.

Another object is to provide a heat exchanger system with relatively high heat transfer coefficients.

Another object is to provide a heat exchanger system with minimal gas pressure drop across each stage of the system.

In accordance with the present invention, a heat exchanger system comprises a housing, means for introducing a gas into the housing, and means for removing a gas from the housing. A stage in gas flow communication with the gas introduction and removal means is provided, and comprises at least one fluidization tray unit disposed within the housing. The fluidization tray unit includes at least a pair of elongated fluidization trays having upturned sides, each tray adapted for containing a shallow bed of particulate matter and being laterally disposed and spaced from each other to form a gas passage therebetween having an input in gas flow communication with the gas introduction means and an output. An elongated fluidization tray cap is disposed on the output side of the gas passage covering the upturned sides and is spaced from the elongated fluidization trays to form a gas communication path between the output side of the gas passage and the volume bounded by the upturned sides. Means for heat extraction are disposed in heat flow communication with the beds of particulate matter.

Further in accordance with the invention, a method for extracting heat from a heat-laden gas stream comprises providing a shallow bed of particulate matter supported by a fluidization tray unit having substantially no resistance to gas flow through the fluidization tray unit, passing the heat-laden gas stream through the fluidization tray unit in order to fluidize the bed of particulate matter, and extracting heat from the fluidized bed of particulate matter by situating a heat transfer surface in heat flow communication with the fluidized bed of particulate matter.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DESCRIPTION OF THE DRAWING

FIG. 3 is a schematic view of a heat exchanger system constructed in accordance with the present invention.

DETAILED DESCRIPTION

Figure 1:
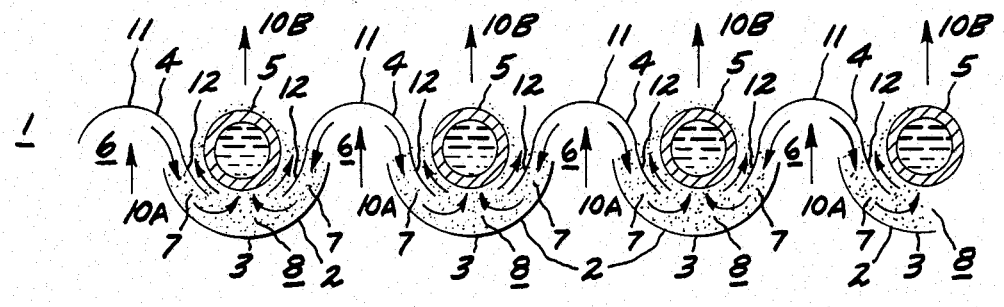
FIG. 1 is a simplified end view showing a stage of a heat exchanger system constructed in accordance with the present invention.

FIG. 1 illustrates a stage 1 of a heat exchanger system constructed in accordance with the present invention. Stage 1 comprises a fluidization tray unit 2 adapted for containing a fluidized bed of particulate matter 8 and a heat extraction means 5 in heat flow communication with the fluidized bed of particulate matter 8.

Fluidization tray unit 2 comprises at least a pair of fluidization trays 3 (four are shown in FIG. 1) laterally disposed and spaced from each other to form a gas passage 6 therebetween for the reception of a gas stream 10A. A fluidization tray cap 4 is disposed at the exit of the gas passage 6 to cooperate with adjacent fluidization trays 3 to form a gas flow path 7 between the exit of the gas passage 6 and the inner side of the fluidization tray 3 so as to communicate with the bed of particulate matter 8.

Each fluidization tray 3 comprises an elongated plate or sheet having upturned sides formed about the longitudinal axis thereof and adapted to support a bed of particulate matter 8 disposed on its inner side. By way of example and not by way of limitation, a trough or tray of transverse cross section having an arcuate, V-shaped or substantially flat floor with outwardly angled longitudinal side walls with raised edges, as shown in Staub et al., U.S. Pat. No. 4,115,929, issued Sept. 26, 1978, and which can be readily manufactured, may be used for the fluidization tray 3. An arcuate cross section is to be preferred as it will tend to minimize the pressure drop across the fluidization tray unit 2. The use of the terms up and down and their various forms are for convenience only and are not to be considered as limiting the orientation which the apparatus may take.

Fluidization tray cap 4 comprises an elongated plate or sheet having downturned sides formed about the longitudinal axis thereof so as to deflect and divert a gas stream impinging thereon. By way of example and not by way of limitation, the fluidization tray cap 4 may be of the same shape as the tray 3. Preferably the fluidization tray cap 4 has an arcuate upper cross section 11 having the outer edges 12 extended and concentric with the proximate upturned side of the preferable fluidization tray 3 having an arcuate cross section with which it cooperates, thereby minimizing the gas pressure drop across the fluidization tray unit 2. The outer edges 12 are preferably extended into the volume defined by the upturned sides of the fluidization tray 3 in order to minimize the flow of particulate matter from the bed of particulate matter 8 through the communicating gas flow path 7 and into the gas passage 6.

A stage 1 of a heat exchanger system constructed in accordance with the present invention operates as follows. A heat-laden fluidizing gas stream 10A is directed into the stage 1 through each gas passage 6 and generally follows gas flow paths through the stage 1 as indicated by the arrows in FIG. 1, eventually forming the exiting gas 10B.

As the input gas stream 10A impinges on each fluidization tray cap 4, a portion of the stream is deflected and diverted onto the inner side of each fluidization tray 3 through gas flow paths 7 associated therewith in order to fluidize the bed of particulate matter 8. A heat extraction means 5 is disposed in heat flow communication with the fluidized bed of particulate matter 8 whereby the heat transfer coefficient of the heat extraction means 5 is increased. Typically, the heat extraction means 5 may comprise a plurality of tubes or pipes containing a liquid such as water.

The heat transfer flow is substantially from the input gas stream 10A to the particulate matter of the fluidized bed 8 and then to the heat extraction means 5. The bed of particulate matter 8 is preferably made shallow in order to minimize the pressure drop therethrough. Because of the shallowness of this bed, it is preferable that the heat extraction means 5 be in heat flow communication therewith only when the bed of particulate matter 8 is in a fluidized state. The fluidized state exists when the particulate matter is rendered into a suspension fluid by introducing gas flow through the bed of matter. The particulate matter of the bed is typically of a lightweight material such as hollow alumina, thus further reducing the pressure drop across the stage 1.

Figure 2:
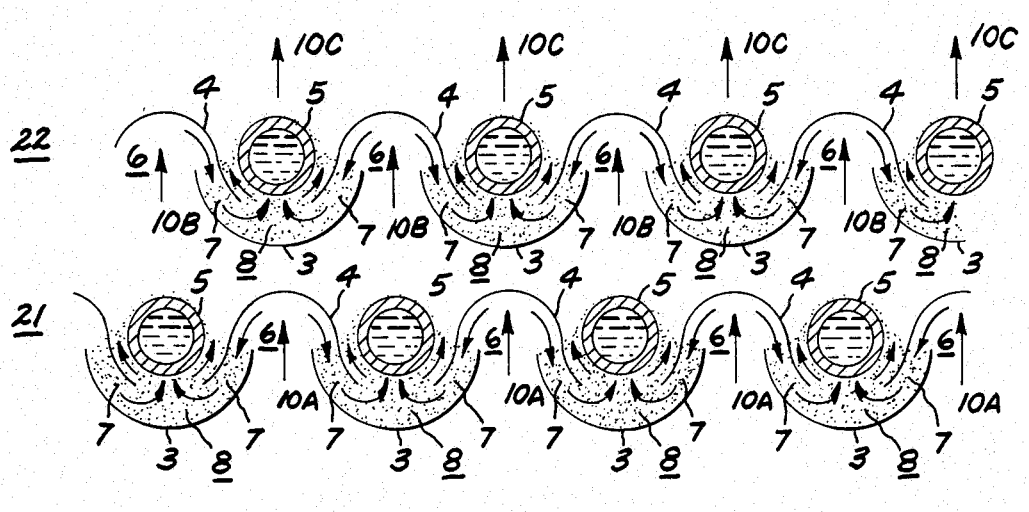
FIG. 2 is a simplified end view showing cooperating stages of a heat exchanger system constructed in accordance with the present invention.
Figure 4:
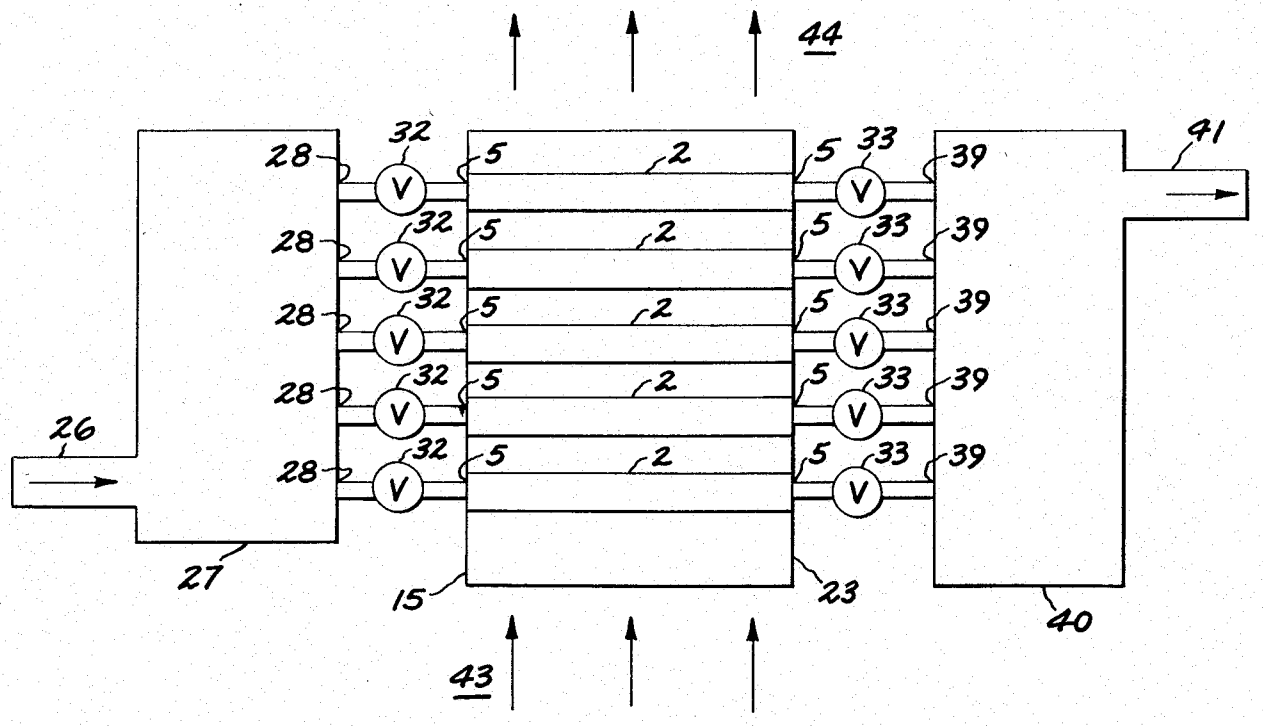

Shown in FIG. 2 are cooperating stages 21, 22 of a heat exchanger system constructed in accordance with the present invention, wherein each stage is constructed as hereinbefore described. Each stage 21, 22 is sequentially disposed with respect to the gas flow stream such that the output gas stream 10B of stage 21 is used as the fluidizing gas input of the next following or upstream stage 22. Thus the output gas stream 10C of stage 22 could be used as the fluidizing gas input of another analogously cooperating stage if desired. Since the pressure drop, and the temperature drop (as described, infra) across each stage are minimized, the temperature of the exiting gas 10B will be maximized, as discussed infra, thus ensuring a maximum temperature driving force at the next sequential stage. It will be understood by those skilled in the art that any number of such cooperating stages but limited by the total pressure drop, may be configured as hereinbefore described without departing from the scope of the present invention.

It is important to avoid the intermixing of particulate matter between serially cooperating stages and to avoid fluidization tray underside heating, since such intermixing and heating will tend to equalize the input temperature of the stages and thereby reduce the temperature driving force which in turn will cause a reduction in exchanger effectiveness. For this reason, the fluidization tray 3 and fluidization tray cap 4 are configured, as hereinbefore described, to minimize the flow of particulate matter through the gas passage 6 and thereby minimize the flow of particulate matter from one serially cooperating stage to another. Further, the input gas 10A velocity should not be so large as to force particulate matter from stage 21 into stage 22 or to excessively heat the underside of the fluidization tray of stage 22.

Shown in FIG. 3 is a heat exchanger system constructed in accordance with the present invention. The system 15 comprises a housing 23 having a plurality of stages 2 disposed therein (five are shown). Each stage 2 comprises heat extraction means 5 and contains a fluidized bed of particulate matter as hereinbefore described. The plurality of stages 2 are sequentially disposed within the housing 23 to be in gas flow communication with the immediately preceding stage as hereinbefore described. A heat-laden gas input stream 43 is directed to enter the housing chamber and a gas output stream 44 is removed from the housing chamber. At least a portion of the input gas 43 is directed to enter lower most stage 2 in order to fluidize the associated bed of particulate matter.

In operation, the heat exchanger system 1 may be used to recover heat from an industrial process waste gas stream which would otherwise be discarded into the environment. The waste gas stream is used as the fluidizing gas input stream 43 of the heat exchanger system 1. In order to beneficially use the heat removed from the waste gas stream, a heat exchange medium such as water may be connected by conduit means 28 and control means 32, such as a valve, in fluid communication with the heat extraction means 5 of a respective stage 2. The connection means 8 may be supplied from a source 26 of heat exchange medium through a heat exchange input control means 27. Heat exchange medium input control means 27 distributes the heat exchange medium to the conduit means 28. The output from the heat extraction means 5 of a respective stage 2 may be connected by control means 33, such as a valve, and conduit means 39 to an output control means 40, such as a header, which may further provide a common output 41. Valves 32 and 33 which are provided on the input and output heat exchange medium lines, respectively, to control the heat exchange medium flow through the heat extraction means 5, may be included as part of the input control means 27 and the output control means 40 respectively.

Some of the benefits which inhere in a heat exchanger system manufactured in accordance with the present invention are: the maintenance of a high temperature driving force, a high heat transfer coefficient and a scrubbing action by the fluidized material on the heat extraction means.

A high temperature driving force, as in a conventional heat exchanger, is obtained by minimizing the temperature drop of the fluidizing gas across a stage 2 of the heat exchanger system 1. A high heat transfer coefficient, for the heat transfer surfaces of the heat extraction means 5 is obtained by disposing the heat transfer surfaces to be in heat flow communication with the bed of particulate matter 8, as shown in FIGS. 1 and 2. The combination of a high temperature driving force and a high heat transfer coefficient, as provided by the present invention, permits a reduction in the heat transfer surface area compared to that needed in a conventional convection heat exchanger for an equivalent rate of heat transfer.

The higher heat transfer coefficient obtainable with the present invention over that of a conventional convection heat exchanger permits a greater quantity of heat to be removed from a fluidizing gas stream for a given heat transfer surface area. The heat transfer surface area of any stage employed in the present invention may thus be reduced from that of a conventional convection heat exchanger while still maintaining an equivalent rate of heat transfer. The reduced heat transfer surface area in that stage reduces the temperature drop across the stage, thereby providing a higher fluidizing gas input temperature to the next successive stage of the present invention than would be provided to the next successive stage in a conventional convection heat exchanger.

The scrubbing action of the fluidized material on the heat extraction means permits a heat exchanger made in accordance with the present invention to be used to recover heat from a relatively dirty gas i.e. one with particulate matter entrained therein. Whereas the entrained particulate matter may tend to adhere to the heat transfer surfaces of a conventional convection heat exchanger and thereby reduce the heat transfer coefficient of those surfaces, the scrubbing action obtained from the fluidized material of the present invention minimizes such particle adherence whereby the high heat transfer coefficient is substantially maintained.

Thus there has been shown a method and an apparatus for increasing the effectiveness of a heat exchanger system and thereby permitting a reduction in the heat transfer surface area for an equivalent heat transfer rate over a conventional convection heat exchanger by maintaining the high temperature driving force of a conventional convection heat exchanger while increasing the heat transfer coefficient of the heat transfer surfaces. Further, the system may be used to recover heat from a particulate-laden gas stream without significantly degrading the heat transfer coefficient.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A method of extracting heat from a heat-laden gas stream comprising the steps of:

(a) providing a fluidization tray unit wherein each unit includes at least two elongated fluidization trays being imperforate and having upturned sides, each tray containing a shallow bed of particulate matter having substantially no resistance to gas flow and each tray being laterally disposed and spaced from one another such that the shallow bed of particulate matter contained therein is not transferred therebetween;

(b) providing means for extracting heat wherein said heat extraction means is spaced from said elongated fluidization trays;

(c) passing the heat-laden gas stream through the fluidization tray unit in order to fluidize each elongated tray of particulate matter such that the fluidized particulate matter is brought in heat flow communication with said heat extraction means only when said particulate matter is fluidized; and (d) extracting heat from the fluidized bed of particulate matter via said heat extraction means.

2. The method as recited in claim 1 including the step of providing additional fluidization tray units sequentially arranged such that at least a portion of the heat-laden gas stream output of one fluidization tray unit is used as the fluidizing gas input to the next successive upstream fluidization tray unit.

3. The method as recited in claim 1 wherein the step of extracting heat further comprises situating the heat extraction means in heat flow communication with a fluid.

4. The method of claim 1 wherein the fluid from each fluidization tray unit is collected in common with the fluid from each of the other fluidization tray units.

5. The method of claim 2 further comprising the step of preventing the interchange of particulate matter between any of said elongated fluidization trays.

6. The method as recited in claim 1 wherein the step of passing the heat-laden gas stream through the fluidization unit comprises:

(a) dividing said heat-laden gas stream into at least two portions each associated with one of said elongated fluidization trays;

(b) directing each of said portions of said heat-laden gas into its respective elongated fluidization tray; and (c) directing each of said portions of said heat-laden gas out of said fluidization unit such that the total volume of heat-laden gas exiting said fluidization tray unit is substantially equal to the total volume of heat-laden gas entering said fluidization tray unit.

* * * * *